United States Patent [19]

Horres et al.

[11] Patent Number: 4,559,040

[45] Date of Patent: Dec. 17, 1985

[54] SEGMENTED PERISTALTIC PUMP CHAMBER

[75] Inventors: Russell Horres, Del Mar; John W. Moers, Fallbrook, both of Calif.

[73] Assignee: Pancretec, Inc., San Diego, Calif.

[21] Appl. No.: 666,554

[22] Filed: Oct. 30, 1984

[51] Int. Cl.[4] ..... F04B 43/08; F04B 45/12

[52] U.S. Cl. ..... 604/153; 417/474; 417/476; 418/45

[58] Field of Search ..... 417/474, 476, 477; 418/45; 604/153

[56] References Cited

U.S. PATENT DOCUMENTS

| | | | |
|---|---|---|---|
| 2,035,159 | 3/1936 | Henry | 417/476 X |
| 3,687,580 | 8/1972 | Griffiths | 418/45 |
| 3,723,030 | 3/1973 | Gelfand | 417/477 X |
| 4,371,321 | 2/1983 | Koblo | 417/474 |
| 4,452,599 | 6/1984 | Albisser et al. | 604/49 |

*Primary Examiner*—Richard E. Gluck

*Attorney, Agent, or Firm*—Selwyn S. Berg

[57] ABSTRACT

A chamber of a peristaltic pump is described wherein a segment of the stator is removed so that said chamber containing the rotor and resilient tube may be stored with the resilient tube not pinched by the eccentric rotor. When the chamber is to be used, a cap is snapped over the chamber which completes the missing segment of the stator and the rotor is engaged to the motor shaft. When the rotor turns in the stator with all segments snapped together, liquid is conducted from inlet to outlet ports.

1 Claim, 1 Drawing Figure

SEGMENTED PERISTALTIC PUMP CHAMBER

BACKGROUND OF INVENTION

Figure 1:
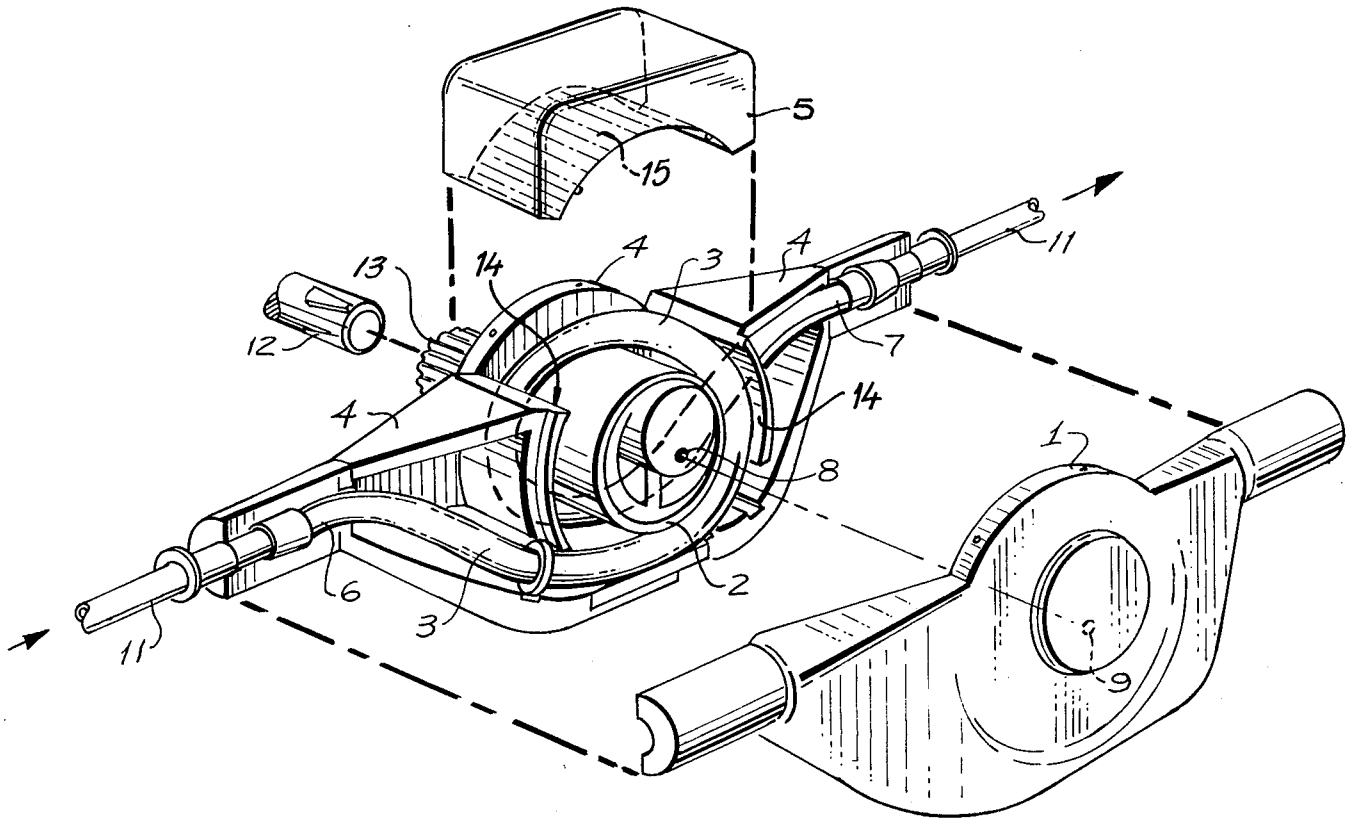

A miniature peristaltic pump is described in Diabetic Care, Volume 3, No. 2 of March–April, 1980. This publication was prior to the application for process U.S. Pat. No. 4,452,599 of Albissor et alia. The work of Albissor concentrated on the concept of a double tube system. The chamber of such a pump holds the tubing and the rotor and is contained inside a cover which constitutes the stator. The eccentric rotor squeezes the resilient tubing which is in a single loop inside the circular stator, and thereby pushes the liquid in the tubing from an inlet port to an outlet port. The major use for peristaltic pumps is Biomedical. Ideally, a pump chamber should be assembled and ready for insertion by connecting the external inlet and outlet ports to tubing running from the source of medication to the sink for medication. However, the structure of the stator and the eccentricity of the rotor results in a pinched resilient tube inside the chamber. Not only can this pinch result in a permanent occlusion, but it prevents gravity flushing of air bubbles from the system. If one removes a chord from the arc of the stator, it will leave the resilient tubing free from becoming pinched at a set position of the rotor, so the tubing remains an open channel. By inserting the arc, the stator is complete and the liquid may be pumped.

The major portion of the structure of a peristaltic pump is in the rotational drive means or motor. This application describes an improvement on the small peristaltic pumps used in medical applications by the introduction of a head system separate from the motor which can be preloaded with tubing and stored for future and rapid use. It also permits the tubing to be loaded with medicament by gravity flow while inserted in the head because of the unoccluded passage if the cap is not attached.

SUMMARY

A segmented stator for a peristaltic pump is described. By removing a segment of the periphery of a stator, an open area is created where the resilient tubing used by a peristaltic pump would not be compressed, avoiding occlusion and facilitating the flushing of air.

DRAWING

FIG. 1 is a drawing of a blow-up of a peristaltic head with a segmented stator.

EMBODIMENT

A Peristaltic pump head comprises a front segmented stator (1), a rotor (2), a loop of resilient tubing (3), and a rear segmented stator (4), and a cap (5). The rear segmented stator (4) has an inner surface, which is an arc (14). The cap (5) also has an inner surface along the radius which is a chord (15). The space between these inner surfaces (14 and 15) and rotor form a tubing track into which the resilient tubing (3) is placed. The resilient tubing (3) is connected to the internal inlet port (6) and internal outlet port (7) in such a manner to loop around the rotor (2). When the rotor marker (8) is aligned with the stator marker (9), the eccentricity of the rotor displaces the resilient tubing into the missing segment of the stator. Mating surfaces engage each other on the front and rear segments of that stator and lock, forming an assembled head. As long as the rotor and stator markers (8 and 9) are aligned, the resilient tubing is not pinched. The external ports (11) may be attached to tubing to create a hydraulic circuit. Air may be flushed from the circuit by either flowing liquid through the system, or holding the circuit vertically to permit the air bubbles to rise. The cap (5) may be snapped onto the chamber which will compress the resilient tube (3). A shaft (12) from a motor engages the rotor on the extremity (13) and causes the rotor (2) to turn, squeezing liquid through the resilient tube (3) conveying said liquid from the inlet port to the outlet port. The fully assembled head may be mated and rigidly attached to a motor shaft creating a pump.

I claim:

1. An improved segmented peristaltic pump head of a combination of a stator, eccentric rotor and rotor extremity, resilient tube, associated inlet and outlet ports with tube holding means where the improvement comprises a removable and replaceable pump head with said stator consisting of a rear segment, a front segment, and a cap, said rear segment housing said eccentric rotor, an arc of less than 300 degrees forming the internal periphery of said rear segment, a tubing track being created by the space between said stator and rotor where said resilient tube is spirally wrapped in said track and held by the tube holding means to said inlet and outlet ports, said front segment acting as a cover to contain said resilient tube and mating with said rear segment, said inlet and outlet ports and tube holding means being formed by the mating of said front and rear segments, said cap attaching to the top of the front and rear segments and providing a surface completing a missing chord of said tubing track, means holding together said front segment, rear segment and cap, whereby when said rear segment, front segment, eccentric rotor, and tube are assembled together without the cap being attached, and the eccentric rotor is oriented to press said resilient tubing into the position of said missing chord with the result that said resilient tubing is not pinched closed so the tubing may be filled and stored ready for use, requiring the attachment of said cap and connection of a rotational drive means to said rotor extremity to deliver liquid medicament to a patient.

* * * * *